US006363704B2

(12) United States Patent
Kim

(10) Patent No.: US 6,363,704 B2
(45) Date of Patent: Apr. 2, 2002

(54) WIRE CABLE FOR WINDOW REGULATORS OF AUTOMOBILES

(76) Inventor: Young-Jo Kim, Seongsin Apt. 201-401, 645-18 Eogok-Dong, Yangsan-Si, Kyung Sangnam-Do (KR)

( * ) Notice: Subject to any disclaimer, the term of this patent is extended or adjusted under 35 U.S.C. 154(b) by 0 days.

(21) Appl. No.: 09/862,382

(22) Filed: May 22, 2001

(30) Foreign Application Priority Data

May 30, 2000 (KR) ..... 2000 29407

(51) Int. Cl.[7] ..... D02G 3/12

(52) U.S. Cl. ..... 57/216; 57/211; 57/220; 57/222; 57/237

(58) Field of Search ..... 57/211, 212, 213, 57/216, 218, 222, 223, 236, 237, 220, 238

(56) References Cited

U.S. PATENT DOCUMENTS 3,240,570 A * 3/1966 Grimes et al. ..... 57/222
3,778,994 A * 12/1973 Humphries ..... 57/222
4,651,513 A * 3/1987 Dambre ..... 57/222
5,475,973 A 12/1995 Furukawa et al.
5,651,245 A * 7/1997 Damien ..... 57/222
5,697,204 A * 12/1997 Kuriya ..... 57/222
5,772,808 A * 6/1998 Kuriya ..... 57/222

* cited by examiner

*Primary Examiner*—Danny Worrell
(74) *Attorney, Agent, or Firm*—DeLio & Peterson, LLC

(57) ABSTRACT

A wire cable for window regulators of automobiles is disclosed. In the wire cable, the core strand has a double-layer twisted strand structure with an F+6+12 element wire structure, and consists of a high-strength synthetic resin filament used as a core element wire (F), six internal element wires primarily twisted around the core element wire to form an internal layer around the core element wire, and twelve external element wires secondarily twisted around the internal layer to form an external layer around the internal layer. Eight external strands, having a single-layer twisted strand structure with a 1+6 element wire structure, are twisted around the core strand to form an 8×7+(F+6+12) element wire structure of the wire cable in cooperation with the core strand. The synthetic resin filament used as the core element wire of the core strand has a diameter slightly larger than that of the internal and external element wires of the core strand. The core strand is also compressed at a compression ratio of 2~10%, thus bringing its element wires into surface contact with each other in place of point contact. In this wire cable, the element wires of the core strand are not likely to be deformed or broken, thus being improved in its fatigue resistance against a repeated bending action, in addition to improving the productivity of the wire cables.

5 Claims, 2 Drawing Sheets

WIRE CABLE FOR WINDOW REGULATORS OF AUTOMOBILES

BACKGROUND OF THE INVENTION

1. Field of the Invention

The present invention relates, in general, to a wire cable for window regulators of automobiles and, more particularly, to a wire cable for such window regulators, using a highly flexible, high-strength synthetic resin filament as the core element wire of its core strand; the core strand being also compressed to deform the cross-section of its element wires and bring the element wires into surface contact with each other in place of point contact, thus improving the flexibility of the wire cable, in addition to the fatigue resistance of the wire cable necessarily enduring a repeated bending action during an operation.

2. Description of the Prior Art

As well known to those skilled in the art, wire cables, used for controlling the operation of a variety of machines or implements, necessarily endure a repeated bending action since they continuously pass over power transmitting rotors, such as sheaves, drums or pulleys, while being tensioned during the operation of said machines or implements. Therefore, the wire cables for such machines or implements must have somewhat high resistance to wear and tear, breakage and frictional abrasion.

In the prior art, the strand structures of the wire cables for such machines or implements have been typically classified into three types: a parallel twisted structure formed by twisting a plurality of element wires together into a wire cable, a single-layer twisted structure formed by twisting a plurality of external element wires around a core element wire, and a multi-layer twisted structure formed by twisting a plurality of internal and/or external strands around a core strand. A single-layer annular strand cable is included in the multi-layer twisted cables, and has been preferably and widely used for controlling the operation of small-sized machines, such as window regulators of automobiles.

The single-layer annular strand cable is produced by twisting a plurality of external strands around one core strand such that the external strands form an annular single layer around the core strand. In the single-layer annular strand cable, each of the external and core strands consists of a plurality of element wires having circular cross-sections with similar diameters. The core element wire of each strand of such a single-layer annular strand cable may comprise one or three filaments. Of the two types of strands having one or three filaments as the core element wire, the strand having one filament as the core element wire has been more preferably used. In addition, one hemp filament in place of the three filaments has been preferably used as the core element wire of each strand of the single-layer annular strand cable.

The wire cable for window regulators of automobiles is a representative example of wire cables, consisting of a plurality of strands each having one steel core element wire. The conventional wire cable for window regulators of automobiles has the following structure.

FIGS. 1*a* and 1*b* are sectional views of conventional wire cables for window regulators of automobiles. As shown in the drawings, the representative examples of conventional wire cables for window regulators of automobiles typically have two element wire structures: an 8×7+1×19 element wire structure and a 7×7 element wire structure. In the element wire structure of the wire cable 11 of FIG. 1*a*, the numeral "8" denotes the number of external strands 11B, "7" denotes the number of element wires in each external strand 11B, "1" denotes the number of core strand 11A, and "19" denotes the number of element wires of the core strand 11A. In the wire cable of FIG. 1*b*, the numeral "7" positioned at the front denotes the number of strands, while the numeral "7" positioned at the back denotes the number of element wires in each strand.

That is, in order to produce the double-layer twisted core strand 11A of the wire cable 11 having the 8×7+1×19 element wire structure, six internal element wires are primarily twisted around one core element wire to form an internal layer around the core element wire. Thereafter, twelve external element wires are secondarily twisted around the internal layer to form the double-layer twisted strand structure of the core strand 11A. On the other hand, each single-layer twisted external strand 11B of the wire cable 11 is produced by twisting eight internal element wires around one core element wire to form the single-layer twisted strand structure of the external strand 11B. Eight external strands 11B are, thereafter, twisted around the core strand 11A to form a desired wire cable 11 having the 8×7+1×19 element wire structure. In order to produce the wire cable 12 having the 7×7 element wire structure, six internal element wires are twisted around one core element wire to form a single-layer twisted strand. After a plurality of single-layer twisted strands, six strands used as external strands 12B are twisted around one strand used as a core strand 12A, thus forming a desired wire cable 12 having the 7×7 element wire structure.

Of the two types of wires cables 11 and 12, the wire cable 11 of FIG. 1*a* has been typically used for controlling the operation of window regulators of small-sized automobiles. The wire cable 12 of FIG. 1*b* has been typically used for controlling the operation of window regulators of large-sized automobiles.

Since the wire cable 12, having the 7×7 element wire structure, is made by twisting six single-layer twisted strands 12B as external strands around one single-layer twisted strand 12A, it has a high abrasion resistance. The wire cable 12 is thus preferably used for controlling a machine, in which the cable 12 is operated while being brought into severe frictional contact with other parts. In addition, the wire cable 12 has a simple strand structure, and so it is not likely to be broken or deformed in its structure.

When such a conventional wire cable 12 is used for transmitting power in a window regulator of an automobile while being wrapped around and passing over power transmitting rotors, such as sheaves, drums or pulleys, the wire cable 12 may be easily, undesirably removed from the rotors during an operation due to low flexibility of the wire cable. The wire cable 12 also has a low fatigue resistance due to its low flexibility, and so the cable 12 may be easily cut or broken during an operation.

The wire cable 11, having the 8×7+1×19 element wire structure and designed to have improved fatigue resistance, has a double-layer twisted core strand 11A with a 1+6+12 element wire structure, in place of the single-layer twisted core strand 12A with a 1+6 element wire structure of the wire cable 12 having the 7×7 element wire structure. In the wire cable 11, the element wires of the core strand 11A each have a diameter smaller than that of each element wire of the external strands 11B. The wire cable 11 having the 8×7+1×19 element wire structure thus has a high flexibility and a high fatigue resistance, different from the wire cable 12 having the 7×7 element wire structure.

However, the conventional wire cable 11 having the 8×7+1×19 element wire structure undesirably has an excessive number of element wires of the core strand, in addition to a complex double-layer twisted strand structure complicating the process of producing the wire cables. Another problem experienced in the wire cable 11 resides in that its core element wires may be more easily cut or broken during a strand twisting process, in comparison with the wire cable 12 having the 7×7 element wire structure. Such wire cables 11 are thus increased in proportion of defectives produced during a wire cable manufacturing process, and so productivity of the wire cables 11 is reduced, with a concurrent increase in the production cost of the cables 11.

It is necessary for the wire cable for window regulators of automobiles, which necessarily perform a continuous, dynamic bending action during an operation, to have a high flexibility and be free from breakage or cutting of their core element wires during a strand twisting process. It is also necessary to allow the element wires of the core strand of the wire cable to come into surface contact with each other in place of point contact, thus making the element wires of the core strand to effectively distribute the external load applied from the external strands to the core strand during an operation and preventing unexpected breakage or cutting of the element wires of the core strand, and preventing any deformation of the element wire structure of the core strand during the operation of the window regulator.

SUMMARY OF THE INVENTION

Accordingly, the present invention has been made keeping in mind the above problems occurring in the prior art, and an object of the present invention is to provide a wire cable for window regulators of automobiles, which uses a highly flexible, highly elastic and high-strength filament as the core element wire of its core strand, with the core and external element wires of the core strand being twisted to come into surface contact with each other in place of point contact, thus effectively distributing external load applied from the external strands to the core strand during an operation.

In order to accomplish the above object, the present invention provides a wire cable for window regulators of automobiles, comprising a core strand and a plurality of external strands twisted around the core strand, wherein the core strand consists of a highly flexible, high-strength synthetic resin filament used as a core element wire, and six internal element wires primarily twisted around the core element wire to form an internal layer around the core element wire, and twelve external element wires secondarily twisted around the internal layer to form a double-layer twisted strand structure of the core strand, the core strand being appropriately compressed to deform the cross-section of its element wires and bring the element wires into surface contact with each other.

That is, the wire cable of this invention includes a core strand having a double-layer twisted strand structure with an F+6+12 element wire structure. This core strand consists of a high-strength synthetic resin filament used as a core element wire (F), six internal element wires primarily twisted around the core element wire to form an internal layer around the core element wire, and twelve external element wires secondarily twisted around the internal layer to form an external layer around the internal layer. The wire cable also includes eight external strands, which have a single-layer twisted strand structure with a 1+6 element wire structure and are twisted around the core strand to form an 8×7+(F+6+12) element wire structure of the wire cable in cooperation with the core strand.

In the wire cable of this invention, the element wires of the core strand, except for the core element wire, have the same diameter as that of the element wires of the external strands. The core element wire of the core strand has a circular cross-section with a diameter larger than that of each of the internal and external element wires of the core strand by 1.1~2.0 times.

The core element wire of the core strand preferably has a diameter of 0.10~0.20 mm, and has a tensile strength similar to that of the steel element wires of the core and external strands. This core element wire of the core strand is selected from high-strength synthetic resin filaments having flexibility and elasticity higher than those of the steel element wires of the core and external strands.

In the present invention, the high-strength synthetic resin filament used as the core element wire of the core strand may be preferably made of high-strength thermoplastic resin, such as polypropylene, polyethylene, polyurethane, or nylon.

In the wire cable of this invention, the highly flexible, highly elastic and high-strength synthetic resin filament, used as the core element wire of the core strand and having a tensile strength of about 50~70 kgf/mm$^2$ similar to that of the steel element wires of the core and external strands, acts as a cushioning material capable of absorbing compression load applied from the external strands to the internal and external steel element wires of the core strand during an operation of the wire cable. The synthetic resin filament used as the core element wire thus protects the steel element wires from damage or deformation due to the compression load, and allows the steel element wires to effectively endure a repeated bending action during an operation of the wire cable.

Particularly, when a machine controlling wire cable, such as a wire cable for window regulators of automobiles, passes over sheaves or pulleys while being tensioned, the wire cable is inevitably deformed in its cross-section from a circular cross-section to an oval cross-section, in addition to having a difference in load applied to the element wires of the strands. Therefore, the conventional wire cable is inevitably deformed in its cross-section when it is used for a lengthy period of time. However, the wire cable of this invention is less likely to be deformed in its cross-section, different from the conventional wire cables, since the wire cable of this invention uses a highly flexible, highly elastic and high-strength synthetic resin filament as the core element wire of its core strand. Therefore, the wire cable of this invention is lengthened in its expected life span, and has high resistance to fatigue.

Prior to twisting the external strands around the core strand in the process of producing the wire cable of this invention, the core strand is compressed at a compression ratio of 2~10%, thus compacting the core strand.

When the core strand of this wire cable is compressed as described above, the cross-section of the internal and external steel element wires of the core strand are deformed from their original circular cross-section while coming into surface contact with each other.

Due to the surface contact of the internal and external element wires of the core strand, the entire contact area between the element wires is increased to uniformly distribute external load applied from the external strands to the core strand, thus preventing an undesired concentration of load to a part of the element wires. This finally almost completely prevents a deformation or breakage of the element wires, in addition to a deformation in the structure of the core strand.

As described above, the range of the compression ratio for the core strand is set to 2~10% for the following reasons. That is, when the compression ratio for the core strand is lower than 2%, it is almost impossible to sufficiently enlarge the contact area between the element wires of the core strand or accomplish the desired load and frictional force distributing effect of the core strand. When the compression ratio for the core strand exceeds 10%, the contact area between the element wires of the core strand is excessively enlarged to restrict a relative movement of the element wires of the core strand, thus undesirably reducing the flexibility of the core strand.

In the prior art, some wire cables for window regulators of automobiles, compressed at a predetermined compression ratio to improve the fatigue resistance of the wire cables, have been proposed. However, such a conventional wire cable is produced by compressing the cable at the external strands after completely twisting the external strands around the core strand during a cable producing process. Such a compression process undesirably damages the anticorrosion film coated on the external element wires of the external strands, thus reducing the corrosion resistance of the wire cables.

However, in the wire cable of this invention, the core strand is compressed prior to the step of twisting the external strands around the core strand, and so the anticorrosion film coated on the external element wires of the external strands is prevented from any damage, different from the conventional wire cables.

BRIEF DESCRIPTION OF THE DRAWINGS

The above and other objects, features and other advantages of the present invention will be more clearly understood from the following detailed description taken in conjunction with the accompanying drawings, in which:

FIGS. 1*a* and 1*b* are sectional views of conventional wire cables for window regulators of automobiles, in which:

FIG. 1*a* is a sectional view of a conventional wire cable having an 8×7+1×19 element wire structure; and FIG. 1*b* is a sectional view of another conventional wire cable having a 7×7 element wire structure; and FIGS. 2*a* and 2*b* are views of a wire cable for window regulators of automobiles in accordance with the preferred embodiment of the present invention, in which:

FIG. 2*a* is a perspective view of the wire cable; and

FIG. 2*b* is a sectional view of the wire cable.

DETAILED DESCRIPTION OF THE INVENTION

Figure 1A:
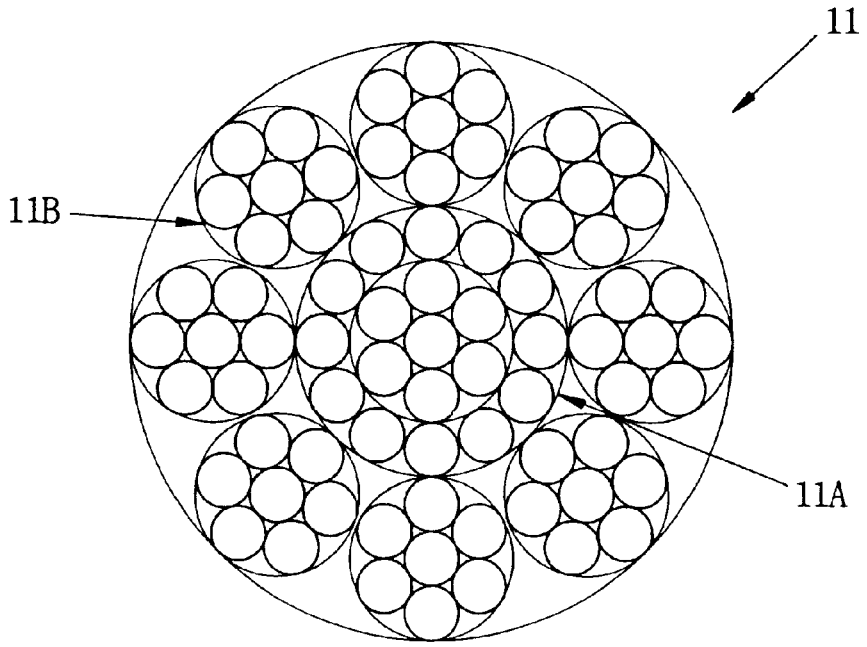
Figure 1B:
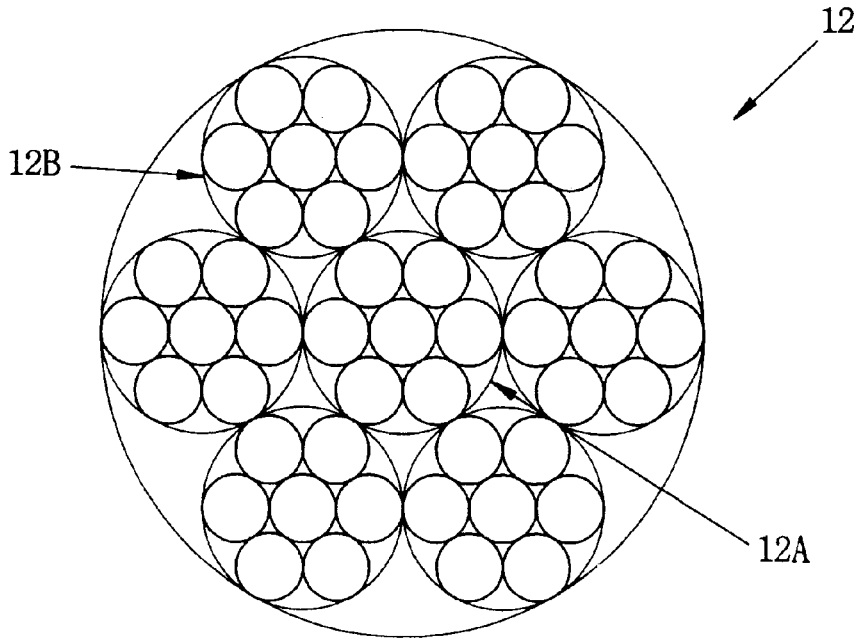

Reference now should be made to the drawings, in which the same reference numerals are used throughout the different drawings to designate the same or similar components.

Figure 2A:
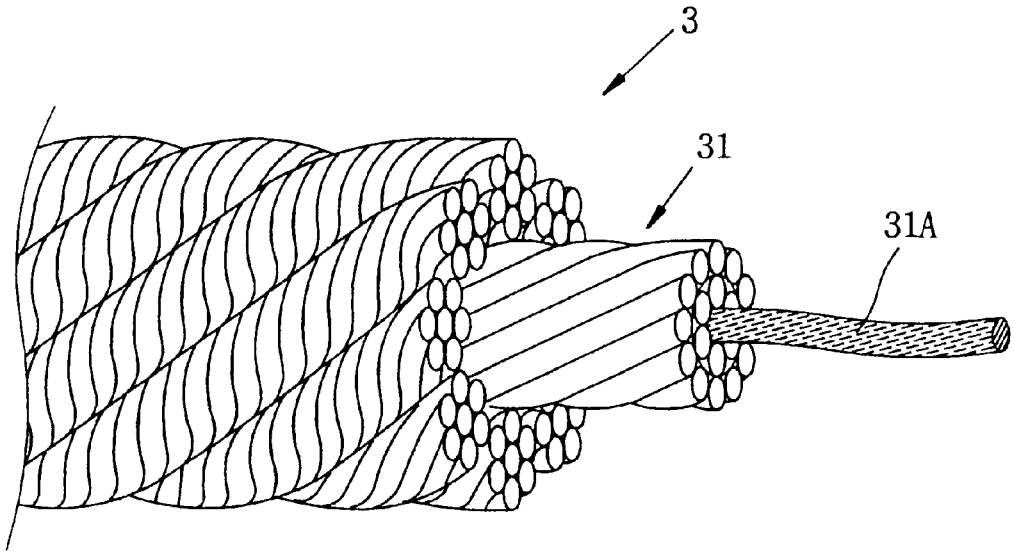
Figure 2B:
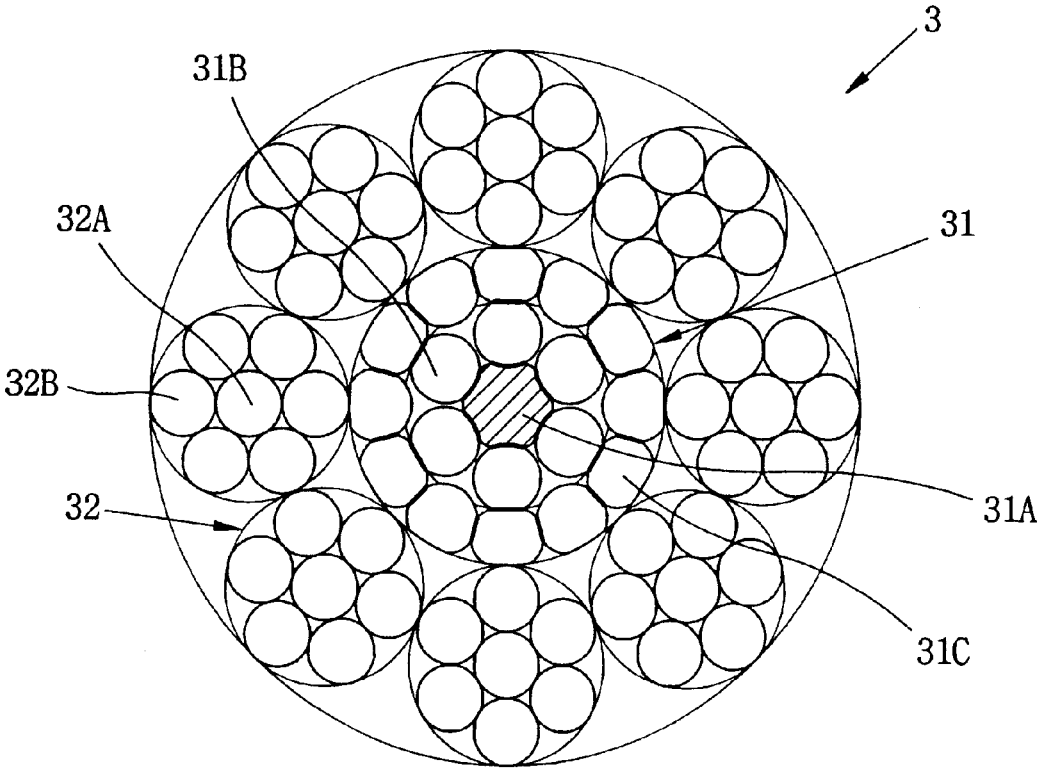

FIGS. 2*a* and 2*b* are a perspective view and a sectional view of a wire cable for window regulators of automobiles in accordance with the preferred embodiment of the present invention.

As shown in the drawings, the wire cable 3 of this invention has one core strand 31 and eight external strands 32 twisted around the core strand 31. The core strand 31 consists of a high-strength synthetic resin filament 31A used as a core element wire, six internal steel element wires 31B primarily twisted around the core element wire 31A to form an internal layer around the core element wire 31A, and twelve external steel element wires 31C secondarily twisted around the internal layer to form an external layer around the internal layer. This core strand 31 thus has a double-layer twisted strand structure with an F+6+12 element wire structure.

On the other hand, the external strands 32, twisted around the core strand 31, each have a 1+6 element wire structure in a conventional manner. That is, in each of the external strands 32, six external element wires 32B are twisted around one core element wire 32A, thus forming a single-layer twisted strand structure with a 1+6 element wire structure. Eight external strands 32 are twisted around the core strand 31 to form a desired wire cable 3 having an 8×7+(F+6+12) element wire structure.

In the wire cable 3, the synthetic resin filament 31A used as the core element wire of the core strand 31 has a diameter slightly larger than those of the internal and external steel element wires 31B and 31C. In such a case, the internal and external element wires 31B and 31C have the same diameter. In addition, the element wires 32A and 32B of each external strand 32 have the same diameter as that of the internal and external steel element wires 31B and 31C of the core strand 31.

During a process of producing the wire cable 3 of this invention, the core strand 31 is compressed prior to the step of twisting the eight external strands 32 around the core strand 31. When the core strand 31 is compressed as described above, the diameter of the strand 31 is reduced. In such a case, the internal and external steel element wires 31B and 31C of the core strand 31 are changed in their cross-sections from original circular cross-sections into deformed cross-sections with reduced diameters. Such a compression process of the core strand 31 also brings the steel element wires 31B and 31C of the core strand 31 into surface contact with each other in place of point contact, thus increasing the contact area between the steel element wires 31B and 31C.

When the core strand 31 is compressed as described above, the synthetic resin filament 31A, used as the core element wire of the core strand 31, is also deformed. That is, since the internal steel element wires 31B compress the synthetic resin filament 31A during the core strand compressing process, the flexible and elastic synthetic resin filament 31A is radially depressed on its external surface at several portions coming into contact with the wires 31B, and is slightly expanded at the other portions between the depressed portions as shown in FIG. 3*b*. Therefore, it is possible for the synthetic resin filament 31A to act as a cushion capable of elastically supporting the internal element wires 31B, in addition to preventing any interference between the element wires 31B.

In order to experimentally prove the operational effect of the wire cables of this invention in comparison with conventional wire cables, a test for measuring the fatigue resistance of the wire cables was carried out, and the measuring results are given in Table 1. In the Table 1, the Examples 1 to 4 embodied the present invention, while the Comparative Examples 1 and 2 embodied the conventional wire cables.

TABLE 1

| Ex. | structure | Diameter of wire cable (mm) | Compression ratio* (%) | Strand diameter ratio (External strand/core Strand) | Compression ratio of core Strand** (%) | Cable pitch (mm) | Fatigue Testing value (times) | Testing times |
|---|---|---|---|---|---|---|---|---|
| Com. Ex 1 | 8 × 7 + 1 × 19 | 1.530 | 3.6 | 56.5% | 6.3 | 12.5 | 7262 | 66 |
| Com. Ex 2 | 8 × 7 + 1 × 19 | 1.545 | 2.8 | 57.4% | 6.9 | 12.5 | 6024 | 33 |
| Ex 1 | 8 × 7 + (F + 18) | 1.498 | 4.3 | 58.4% | 9.2 | 12.5 | 12170 | 9 |
| Ex 2 | 8 × 7 + (P + 18) | 1.499 | 4.8 | 57.8% | 8.2 | 12.5 | 17821 | 49 |
| Ex 3 | 8 × 7 + (F + 18) | 1.514 | 3.8 | 57.8% | 8.2 | 12.5 | 16220 | 53 |
| Ex 4 | 8 × 7 + (F + 18) | 1.531 | 3.5 | 56.5% | 6.3 | 12.5 | 8855 | 28 |

$$\text{Compression ratio}^{*} = \frac{2\times\alpha+\beta-\delta}{2\times\alpha+\beta}\times 100$$

$$\text{Compression ratio of core strand}^{**} = \frac{\eta+\gamma\times 4-\varphi}{\eta+\gamma\times 4}\times 100$$

In the above expressions, $\alpha$ is the diameter of each external strand, $\beta$ is the diameter of the core strand, $\delta$ is the diameter of the compressed wire cable, $\eta$ is the diameter of the core element wire, $\gamma$ is the diameter of each external element wire, and $\phi$ is the diameter of the compressed core strand.

In the Table 1, the element wire structure of each of Examples 1 to 4 is expressed by "8×7+(F+18)", which is only another expression of the aforementioned structure "8×7+(F+6+12)". That is, since the numeral "18" in the expression "8×7+(F+18)" is resulted from the sum of the numbers of the internal and external element wires, the term "(F+6+12)" is expressed by the term "(F+18)".

In the test, the wire cables of Examples 1 to 4 and the wire cables of Comparative Examples were made using element wires having both the same diameter and the same tensile strength.

In addition, the test was performed under the condition that each wire cable was reciprocated within a distance of 200 mm at a rate of seven times per minute while being loaded with 280N. During the reciprocating movement of each wire cable, the wire cable was bent using one drum having a diameter of 30 mm and two ball bearings having a diameter of 19 mm. The test for each wire cable has carried out until at least one strand was broken or cut.

From the Table 1, it is easily seen that the fatigue resistance of the wire cable according to this invention is remarkably improved, in comparison with the conventional wire cables.

As described above, the present invention provides a wire cable for window regulators of automobiles. In the wire cable of this invention, the core strand is compressed to deform the cross-section of its internal and external steel element wires from their original circular cross-section and bring the element wires into surface contact with each other while enlarging the entire contact area between the element wires. Since the wire cable uses a high-strength synthetic resin filament as the core element wire of its core strand, the wire cable has a high flexibility, in addition to uniformly distributing the external load applied from the external strands to the core strand. Therefore, the wire cable has a high resistance to fatigue when the cable passes over sheaves or pulleys while being repeatedly bent.

Since a highly flexible, highly elastic and high-strength synthetic resin filament is used as the core element wire of the core strand of the wire cable, the wire cable is not likely to be undesirably deformed in its cross-section or structure. In an operation of the wire cable, external load applied from the external strands to the core strand is uniformly distributed by the element wires of the core strand without being concentrated to a part.

Due to use of the synthetic resin filament as the core element wire of the core strand, it is possible to almost completely prevent undesired cutting or breakage of the core element wire during a wire twisting process, different from a conventional core element wire made of steel. In addition, it is not necessary to use a steel core element wire having a diameter different from that of the internal and external steel element wires of the core strand, different from the conventional wire cable; and the process of producing the wire cables is simplified to improve the productivity of the wire cables. In addition, when differently coloring the synthetic resin filaments of the core strands of wire cables, it is possible for users to easily distinguish the wire cables of one manufacturer from those of another manufacturers.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A wire cable for window regulators of automobiles, comprising:

a core strand having a double-layer twisted strand structure with an F+6+12 element wire structure, said core strand consisting of:

a high-strength synthetic resin filament used as a core element wire (F);

six internal element wires primarily twisted around said core element wire to form an internal layer around the core element wire; and twelve external element wires secondarily twisted around the internal layer to form an external layer around the internal layer; and eight external strands having a single-layer twisted strand structure with a 1+6 element wire structure, said external structure being twisted around said core strand to form an 8×7+(F+6+12) element wire structure of the wire cable in cooperation with the core strand.

2. The wire cable according to claim 1, wherein said core strand is compressed at a compression ratio of 2~10%.

3. The wire cable according to claim 1 or 2, wherein the core element wire, internal element wires and external element wires of said core strand are brought into surface contact with each other.

4. The wire cable according to claim 1, wherein said synthetic resin filament has a diameter larger than that of each of the internal and external element wires of the core strand by 1.1~2.0 times.

5. The wire cable according to claim 1, wherein said synthetic resin filament is made of high-strength thermoplastic resin.

* * * * *

UNITED STATES PATENT AND TRADEMARK OFFICE

CERTIFICATE OF CORRECTION

PATENT NO. : 6,363,704 B2
DATED : April 2, 2002
INVENTOR(S) : Kim

It is certified that error appears in the above-identified patent and that said Letters Patent is hereby corrected as shown below:

Column 7,
Line 4, delete "8x7 + (P + 18)", and substitute therefore -- 8x7 + (F + 18) --
Line 24, delete "Φ" and insert therefore -- φ --.
Line 46, delete "has" and substitute therefore -- was --.

Signed and Sealed this

First Day of October, 2002

*Attest:*

*Attesting Officer*

JAMES E. ROGAN
*Director of the United States Patent and Trademark Office*